US011098975B2

(12) United States Patent
Evans

(10) Patent No.: US 11,098,975 B2
(45) Date of Patent: Aug. 24, 2021

(54) ATTACHMENT BRACKET FOR MOUNTING A SIGHT OR OTHER TARGETING DEVICE TO A BOW FOR HUNTING AT NIGHT

(71) Applicant: Phillip Evans, Lometa, TX (US)

(72) Inventor: Phillip Evans, Lometa, TX (US)

( * ) Notice: Subject to any disclaimer, the term of this patent is extended or adjusted under 35 U.S.C. 154(b) by 0 days.

(21) Appl. No.: 16/218,103

(22) Filed: Dec. 12, 2018

(65) Prior Publication Data

US 2019/0178605 A1 Jun. 13, 2019

Related U.S. Application Data

(60) Provisional application No. 62/598,350, filed on Dec. 13, 2017.

(51) Int. Cl.

| | |
|---|---|
| ***F41B 5/14*** | (2006.01) |
| ***F41G 1/467*** | (2006.01) |
| *F41G 11/00* | (2006.01) |

(52) U.S. Cl.

CPC ..... *F41B 5/1492* (2013.01); *F41B 5/148* (2013.01); *F41G 11/003* (2013.01); *F41G 11/005* (2013.01)

(58) Field of Classification Search

CPC ..... F41G 1/467; F41G 11/00; F41G 11/003; F41G 11/005; F41B 5/14; F41B 5/148; F41B 5/1492

USPC ..... 33/267; 124/86, 87

See application file for complete search history.

(56) References Cited

U.S. PATENT DOCUMENTS

| | | | | |
|---|---|---|---|---|
| 5,507,272 | A * | 4/1996 | Scantlen | F41G 1/467 124/87 |
| 6,397,483 | B1 * | 6/2002 | Perkins | F41G 1/467 124/87 |
| 6,449,419 | B1 * | 9/2002 | Brough | F41G 1/35 385/136 |
| 6,526,666 | B1 | 3/2003 | Lastinger, Jr. | |
| 6,539,661 | B2 * | 4/2003 | Hope | F41C 27/00 42/119 |

(Continued)

OTHER PUBLICATIONS

Kevin Reese, Setting Up your Bow for Night Hunting—Welcome to the Dark Side, SHWAT: Special Hunting Weapons and Tactics, Apr. 22, 2016 [online], [retrieved on Aug. 16, 2017]. Retrieved from the Internet <https://shwat.com/setting-up-your-bow-for-night-hunting-welcome-to-the-dark-side/>.

(Continued)

*Primary Examiner* — Alexander R Niconovich

(74) *Attorney, Agent, or Firm* — Craige Thompson; Thompson Patent Law; Timothy D. Snowden

(57) ABSTRACT

Apparatus and associated methods relate to a mounting bracket for coupling a sight or other targeting device to a bow. In an illustrative example, the sight may be a thermal or night-vision sight, and an electronic device may optically couple to the sight for displaying a view through the sight on a display screen of the electronic device. The sight may fixedly couple to the mounting bracket via, for example, a Picatinny-style rail/mount. An on-the-fly windage/elevation adjustment mechanism may allow for adjustments, for example, to the windage and/or elevation of the sight coupled to the mounting bracket. The mounting bracket may utilize, for example, a thermal or night-vision sight that may be beneficial for use in low light conditions, such as bow hunting at night.

20 Claims, 7 Drawing Sheets

(56) References Cited

U.S. PATENT DOCUMENTS

| | | | | |
|---|---|---|---|---|
| 6,556,245 | B1 * | 4/2003 | Holmberg | F41B 5/1492 348/333.01 |
| 6,644,297 | B1 * | 11/2003 | Brown, Jr. | F41G 1/467 124/87 |
| 6,862,813 | B1 * | 3/2005 | Chen | F41G 1/467 33/263 |
| 7,255,035 | B2 * | 8/2007 | Mowers | F41G 1/467 42/131 |
| 8,240,077 | B2 * | 8/2012 | Holmberg | F41G 1/473 42/142 |
| 8,297,173 | B1 * | 10/2012 | Teetzel | F41G 3/165 89/41.17 |
| 8,353,455 | B1 * | 1/2013 | Huang | F41G 1/345 235/404 |
| 8,468,930 | B1 * | 6/2013 | Bell | F41G 1/38 89/204 |
| 8,656,625 | B2 * | 2/2014 | Holmberg | F41G 11/004 42/90 |
| 8,776,386 | B2 * | 7/2014 | Kingsbury | F41G 1/467 33/265 |
| 8,819,983 | B2 * | 9/2014 | Tate | F16M 11/041 42/90 |
| 8,839,776 | B2 * | 9/2014 | Kingsbury | F41B 5/1426 124/89 |
| 8,971,959 | B2 * | 3/2015 | Hunt | F16M 11/041 455/557 |
| 8,978,539 | B2 * | 3/2015 | Teetzel | F41G 1/36 89/41.05 |
| 9,383,169 | B2 * | 7/2016 | Donovan | F41G 1/345 |
| 9,411,215 | B2 * | 8/2016 | Hunt | G02B 23/00 |
| 9,429,392 | B1 * | 8/2016 | Ledbetter | F41B 5/1469 |
| 9,671,191 | B1 * | 6/2017 | Sullivan | F41B 5/1492 |
| 10,281,232 | B2 * | 5/2019 | Pell | A63B 21/4043 |
| 10,408,565 | B2 * | 9/2019 | Albrecht | F41C 27/00 |
| 10,591,249 | B2 * | 3/2020 | Campbell | F41G 1/36 |
| 2004/0007224 | A1 * | 1/2004 | Brown, Jr. | F41G 1/467 124/87 |
| 2005/0246910 | A1 * | 11/2005 | Mowers | F41G 1/467 33/266 |
| 2012/0046100 | A1 * | 2/2012 | Roman | F41G 1/467 463/30 |
| 2013/0000622 | A1 * | 1/2013 | McCauley | F41G 11/001 124/88 |
| 2013/0111798 | A2 * | 5/2013 | Russell | F41G 1/387 42/90 |
| 2015/0040409 | A1 * | 2/2015 | Morrison | F41G 1/467 33/228 |
| 2015/0168104 | A1 * | 6/2015 | Donovan | F41G 1/467 33/265 |
| 2016/0025456 | A1 * | 1/2016 | Hamm | F41G 1/41 33/265 |
| 2017/0261289 | A1 * | 9/2017 | Lasco | F41G 3/08 |
| 2018/0347948 | A1 * | 12/2018 | VanCamp | F41G 3/065 |

OTHER PUBLICATIONS

Inteliscope Thermal Archery-Bundle for Android, Amazon, n.d. [online], [retrieved on Dec. 11, 2018]. Retrieved from the Internet <https://www.amazon.com/Inteliscope-Thermal-Archery-Bundle-for-Android/dp/B073KG438T>.

Deltavarchery, Archery Night Vision Hog, YouTube, Mar. 18, 2014 [online], [retrieved on Aug. 16, 2017]. Retrieved from the Internet <https://www.youtube.com/watch?v=o_guiXw9CAQ>.

ND3-Bow Subzero: Archery Laser Illuminator, Laser Genetics, n.d. [online], [retrieved on Aug. 16, 2017]. Retrieved from the Internet <http://www.lasergenetics.com/nd3BOW.aspx>.

Killerstabs, Night Vision for your bow, TacVector Laser Designators, Oct. 25, 2011 [online], [retrieved on Aug. 16, 2017]. Retrieved from the Internet <https://www.archerytalk.com/vb/showthread.php?t=1609128>.

DAS Bows Dalaa Riser Bracket, Three Rivers Archery Supply, n.d. [online], [retrieved on Aug. 16, 2017]. Retrieved from the Internet <https://www.3riversarchery.com/das-bows-dalaa-riser-bracket.html>.

Midwest Orion Smartphone Camera Bow Phone Mount for Use with Iphone, Samsung, GoPro, and More, n.d. [online], [retrieved on Aug. 16, 2017]. Retrieved from the Internet <https://www.amazon.com/Smartphone-Camera-Phone-Iphone-samsung/dp/B00BVF6V5Q>.

CrazyArchery: Smartphone Bow Mounts, Crazy Archery, n.d. [online], [retrieved on Aug. 16, 2017]. Retrieved from the Internet <http://crazyarchery.com/>.

S4Gear Jackknife Smartphone Bow Mount, Bass Pro Shops, n.d. [online], [retrieved on Aug. 16, 2017]. Retrieved from the Internet <https://www.basspro.com/shop/en/s4gear-jackknife-smartphone-bow-mount>.

Green Laser Sight Picatinny Rail for Combound Bow Bowhunting Bowfishing, ebay, n.d. [online], [retrieved on Aug. 16, 2017]. Retrieved from the Internet <https://www.ebay.com/p/Green-Laser-Sight-Picatinny-Rail-for-Compound-Bow-Bowhunting-Bowfishing/1331896963?iid=112264148845>.

Phone Mount for Picatinny Rail, Third Coast Thermal, n.d. [online], [retrieved on Aug. 16, 2017]. Retrieved from the Internet <https://third-coast-thermal-llc.myshopify.com/collections/newest-products/products/phone-mount-for-picatinny-rail>.

TRUGLO Picatinny Bow Accessory Mount Stabilizer Black, Amazon, n.d. [online], [retrieved on Aug. 16, 2017]. Retrieved from the Internet <https://www.amazon.com/Truglo-Picatinny-Accessory-Mount-Stabilizer/dp/B00I4J7QZQ>.

Green Laser Bow Sight, Mathews, Hoyt, Browning, PSE, Any Bow with Stabilizer Hole, ebay, n.d. [online], [retrieved on Aug. 16, 2017]. Retrieved from the Internet <https://www.ebay.com/i/260598990765?rt=nc>.

AimSHOT BMT-700 Adjustable Picatinny Rail Bow Mount, ebay, n.d. [online], [retrieved on Dec. 11, 2018]. Retrieved from the Internet <https://www.ebay.com/itm/AimSHOT-BMT-700-Adjustable-Picatinny-Rail-Bow-Mount-/152332023769>.

High Performance Thermal Imaging, Seek Thermal, n.d. [online], [retrieved on Dec. 11, 2018]. Retrieved from the Internet <https://www.thermal.com/commercial-trades.html>.

Matthew Collins, Review: Seek Thermal Camera with Inteliscope Mount, Pew Pew Tactical, Feb. 16, 2018 [online], [retrieved on Dec. 11, 2018]. Retrieved from the Internet <https://www.pewpewtactical.com/seek-thermal-inteliscope/>.

MOD Armory PVS-14 iPhone Adapter, MOS Armory, n.d. [online], [retrieved on Dec. 12, 2018]. Retrieved from the Internet <https://www.modarmory.com/product/mod-armory-pvs-14-iphone-adapter/>.

* cited by examiner

ATTACHMENT BRACKET FOR MOUNTING A SIGHT OR OTHER TARGETING DEVICE TO A BOW FOR HUNTING AT NIGHT

CROSS-REFERENCE TO RELATED APPLICATIONS

This application claims the benefit of U.S. Provisional Application Ser. No. 62/598,350, titled "Attachment Bracket for Mounting a Sight or Other Targeting Device to a Bow for Hunting at Night," filed by Phillip Evans, on Dec. 13, 2017.

This application incorporates the entire contents of the foregoing application(s) herein by reference.

TECHNICAL FIELD

Various embodiments relate generally to bow hunting.

BACKGROUND

The art of hunting has been practiced by human kind for countless millennia. Over the ages, humans have hunted different types of prey using different types of weapons. For example, a slingshot is a projectile weapon that may be used to hunt small animals, such as rabbits or squirrels. A spear-thrower (also known as an atlatl) is another type of projectile weapon that uses leverage to achieve greater velocity in dart-throwing, and includes a bearing surface which allows the user to store energy during a spear throw.

A bow and arrow is a ranged weapon that includes an elastic launching device (bow) and a long-shafted projectile (arrow). The bow and arrow has been a particularly effective hunting tool for humans, as it is a moderate-range projectile weapon that can be used while moving or riding on horseback. There are a variety of different types of bow designs that have been developed over the years. Specific types of bow designs include recurve bows, longbows, compound bows, and composite bows.

SUMMARY

Apparatus and associated methods relate to a mounting bracket for coupling a sight or other targeting device to a bow. In an illustrative example, the sight may be a thermal or night-vision sight, and an electronic device may optically couple to the sight for displaying a view through the sight on a display screen of the electronic device. The sight may fixedly couple to the mounting bracket via, for example, a Picatinny-style rail/mount. An on-the-fly windage/elevation adjustment mechanism may allow for adjustments, for example, to the windage and/or elevation of the sight coupled to the mounting bracket. The mounting bracket may utilize, for example, a thermal or night-vision sight that may be beneficial for use in low light conditions, such as bow hunting at night.

Various embodiments may achieve one or more advantages. For example, some embodiments may advantageously allow for a user to utilize a thermal/night-vision sight without requiring the user's eye to be proximate to the viewer of the thermal/night-vision sight. A smartphone may align with the viewer of the sight, provide for a large enough screen for a user to view from over a foot away, and be lightweight enough to be supported on a bow without making the bow unwieldy. A canted (downward) sight support section, in some embodiments, may advantageously allow for more accurate bow aiming, due to the downward (parabolic) arc an arrow travels when under the force of gravity. An angle-adjustable sight support section having a pivot point may advantageously allow for a user to adjust the angle the sight support section makes with respect to the rest of the mounting bracket. A unitary construction mounting bracket may advantageously reduce the number of parts needed to mount a sight to a bow, and may experience less wear than a bracket having movable parts that may frictionally engage one another. An on-the-fly windage/elevation adjustment mechanism may advantageously allow for quick, immediate, and toolless adjustments to windage/elevation. A mounting bracket with multiple Picatinny-style rails may advantageously allow for mounting of multiple devices to the mounting bracket. A unique and distinctive apparatus for night hunting with a bow may beneficially integrate a mounting system that enables use of thermal and/or night vision sights mounted to the bow. In some examples, the mounting system may, for example, replace daytime pin sights on a bow with a non-proprietary design. Some design implementations may provide for increased standoff distance, which may advantageously provide for enough space away from a bow to allow for a thermal or night vision sight to be mounted on a mounting bracket. Various examples of a mounting bracket may be formed of a high-strength material (such as aluminum or steel), and may be durable, sturdy, and heavy duty, such that the mount can withstand the vibrations of a bow when the bow is being fired by a user. Various embodiments may enable a user to see farther, with a larger field-of-view (FOV), and provide for a clearer image and increased hot spot detection distance. Some implementations may provide a hunter with all the benefits of a thermal or night vision sight, while giving the user the ability to draw and fire a bow with minimal encumbrance.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1:
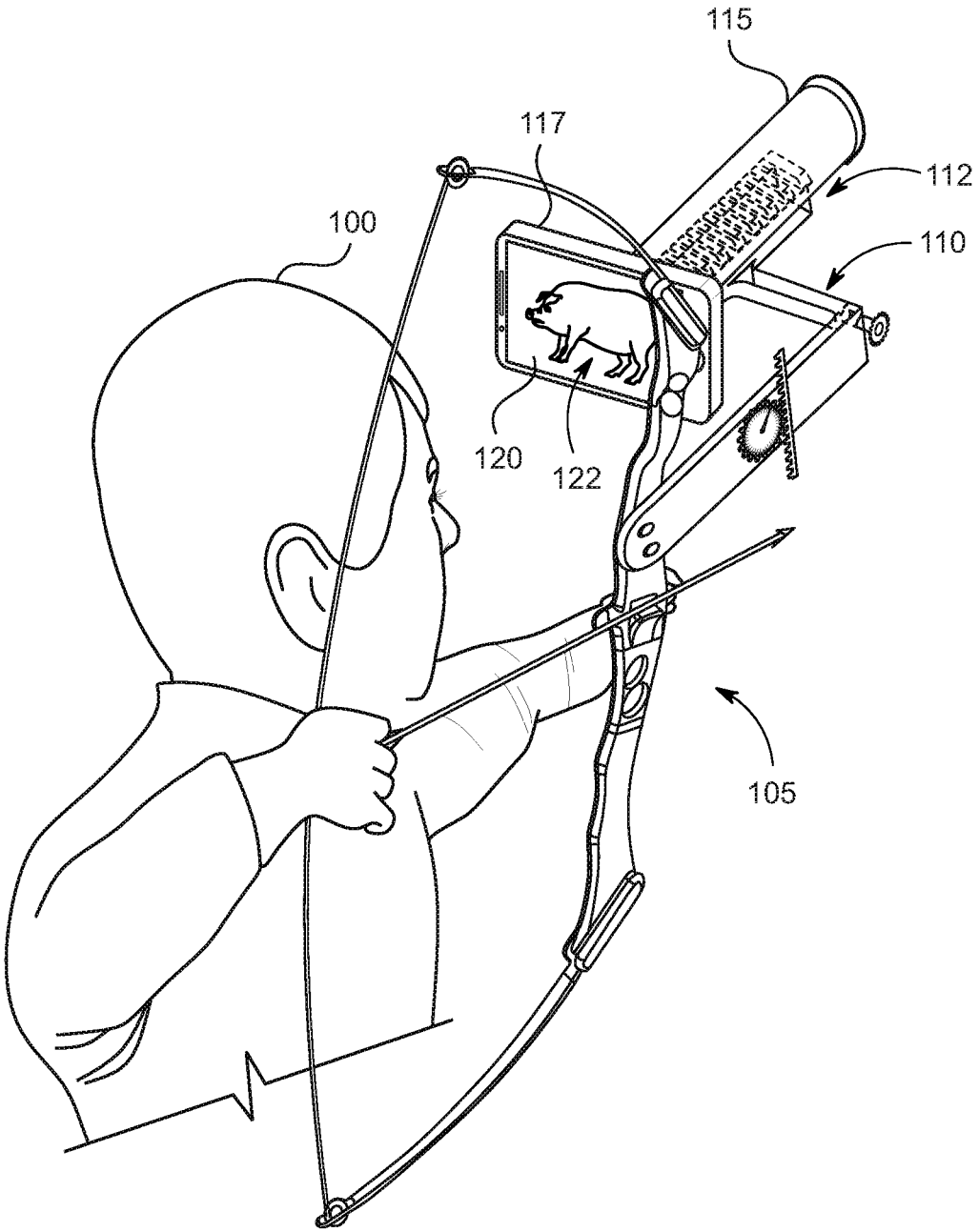
FIG. 1 depicts a perspective view of an exemplary bow being used with an exemplary mounting bracket that supports an exemplary sight optically coupled to an exemplary electronic display device.

FIG. 1 depicts a perspective view of an exemplary bow being used with an exemplary mounting bracket that supports an exemplary sight optically coupled to an exemplary electronic display device. In this illustrative example, a user/hunter 100 is drawing a bow 105. Mechanically coupled to the bow 105 is a mounting bracket 110. The mounting bracket 110 includes a Picatinny-style mounting interface 112 on which a sight 115 (e.g., a thermal or night vision sight) is mounted. Optically coupled to a viewer of the sight 115 is an electronic display device 120. The electronic device 120 has a camera (not shown) configured to peer into the viewer of the sight 115. The electronic device 120 also includes a display screen 122 visible to the user 100, such that the images seen through the sight 115 are displayed on the display screen 122 in real-time. The electronic display device 120 is retained in an electronic display device retainer 117 that is mechanically coupled (e.g., fixedly) to the mounting bracket 110. For example, the retailer 117 may be welded or integrally formed with, the bracket 110. In this exemplary depiction, the display screen 122 depicts prey (a wild boar) that the hunter 100 is currently stalking/hunting. The wild boar is being observed through the sight 115, which may be adapted specifically for hunting at night, such that the display screen 122 may display a thermal heat signature of the wild boar, for example, that can be observed by the user 100. Displaying these real-time images on the display screen 122 of the electronic device 120 may advantageously allow the user 100 to utilize the sight 115 without requiring the user's eye to be proximate to the viewer of the sight 115. Furthermore, the real-time images of prey (the wild boar) using a thermal or night vision sight 115 may beneficially allow the hunter 100 to stalk and hunt prey animals during night time hours, which would be virtually impossible without the aid of the bracket 110, the sight 115, and the display device 120.

To adjust the windage/elevation of the mounting bracket 110 relative to the bow 105, the user 100 may use an elevation adjustment and/or a windage adjustment mechanism (see, e.g., FIGS. 4A-5B). In some embodiments, the elevation and windage adjustments may be integrated with the mounting bracket 110. In some examples, the elevation and windage adjustments may be separate from the mounting bracket 110.

In some embodiments, the sight 115 may be a thermal sight. A thermal sight may be beneficial for use in low light conditions, such as hunting at night. For example, a farmer experiencing a problem with wild hogs may use a thermal sight to pinpoint hogs during non-daylight hours for extermination. A thermal sight may advantageously detect a prey animal in deep cover or hidden by fog. In some examples, the sight 115 may be a night vision sight. A night vision sight may be beneficial for use in low light conditions, such as hunting at night. A night vision sight may advantageously provide for a more natural image versus a thermal sight, and may also be more rugged, cheaper, and lightweight than a thermal sight.

In various embodiments, the sight 115 may be a laser sight. A laser sight may beneficially aid in achieving a more accurate shot with a bow by placing a visual indicator on the target. The laser sight may be a green laser sight, which may provide visual feedback for a user operating the bow 105. The laser sight may be an infrared (IR) laser sight, which may advantageously mark a target with an IR mark that can be seen through a night vision sight. In some examples, more than one sight 115 may be mounted on the mounting bracket 110. For example, a thermal sight, a night vision sight, and a laser sight may all be mounted onto the mounting bracket 110 (see, e.g., FIG. 8).

In various examples, the electronic display device 120 may be a smartphone. A smartphone may advantageously easily couple to the viewer of the sight 115, provide for a large enough screen for a user to view from over a foot's distance away, and be lightweight enough to be supported on a bow without making the bow unwieldy. A smartphone may also execute code that may perform image recognition functions for identifying prey. In some examples, more than one electronic device 120 may be used. For example, a mounting bracket 110 that supports both a thermal sight and a night vision sight may use one electronic device for displaying the view through the thermal sight, and another electronic device for displaying the view through the night vision sight. In some embodiments, the electronic device 120 may be supported by the mounting bracket 110. In various examples, the electronic device 120 may couple to a viewer of the sight 115. In some embodiments, the electronic device 120 may be integrated with the sight 115. The display screen 122 of the electronic device 120 may be on one surface of the electronic device 120, while the camera of the electronic device 120 may be on another (oppositely facing) surface of the electronic device 120.

Figure 2A:
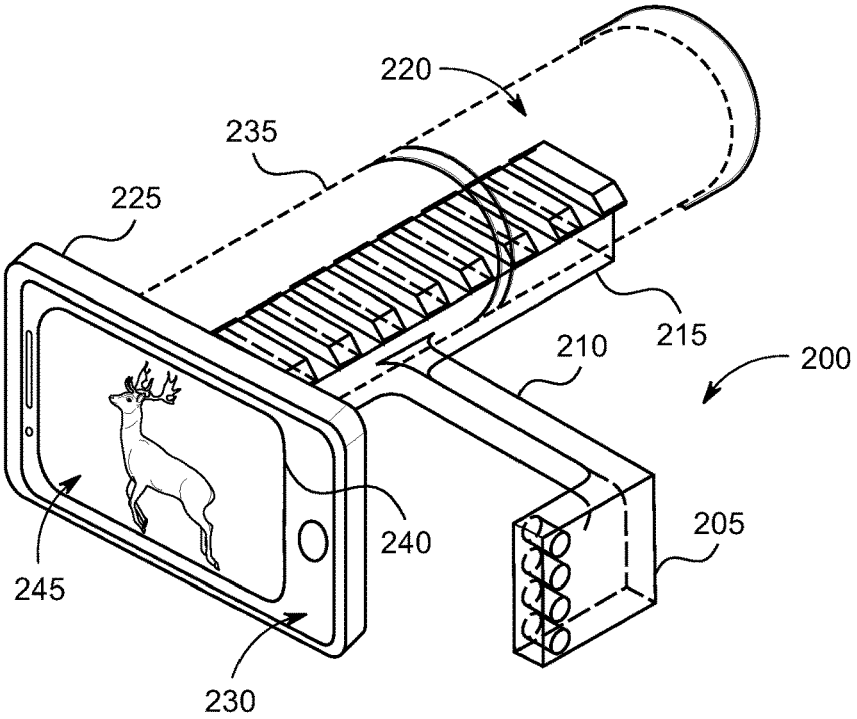
FIGS. 2A and 2B depicts top back perspective views of exemplary mounting brackets being used in conjunction with exemplary sights and exemplary electronic display devices.
Figure 2B:
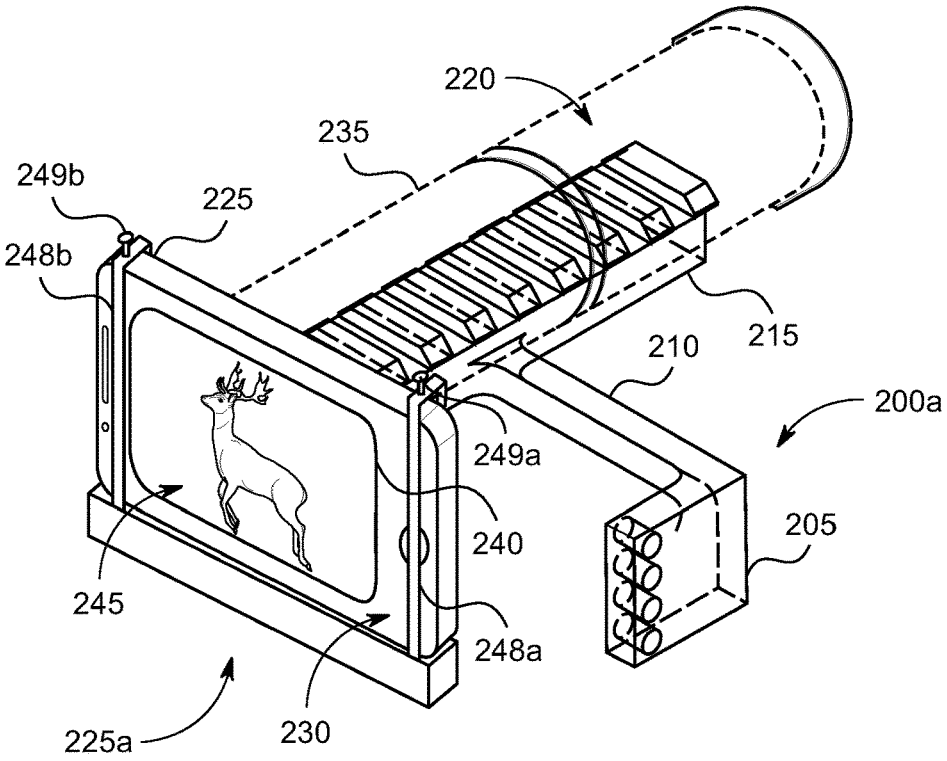

FIGS. 2A and 2B depicts top back perspective views of exemplary mounting brackets being used in conjunction with wexemplary sights and exemplary electronic display devices. As shown in FIG. 2A, a mounting bracket 200 includes a bow coupling section 205, a laterally extending bridge 210, and a longitudinally extending sight support and mounting section 215. Included with the sight support section 215 is a Picatinny-style rail 220. In this exemplary depiction, the mounting bracket 210 is a unitary-construction bracket. A unitary construction mounting bracket 210 may advantageously reduce the number of parts needed to mount a sight to a bow, and may experience less wear than a bracket having movable parts that may frictionally engage one another. The bow coupling section 205 of the mounting bracket 200 may couple to the bow directly or indirectly. For example, the bow coupling section 205 may indirectly mechanically couple to a bow via an intermediate coupling mount. The bow coupling section 205 may couple to a bow or the intermediate coupling mount by use of a fastening mechanism, such as a screw or pin, for example. In some examples, the Picatinny-style rail 220 may be integrally formed with the mounting bracket 200, so that the Picatinny-style rail 220 is part of the unitary construction mounting bracket 200. For example, the sight support section 215 and the Picatinny-style rail 220 may be unified together. In some embodiments, the sight support section 215 may support multiple Picatinny-style rails 220 (see, e.g., FIG. 8).

The mounting bracket 200 includes an electronic display device retainer 225. Loaded/retained in the device retainer 225 is an electronic display device 230 (e.g., a smartphone such as an iPhone®). The position of the device retainer 225 may be adjusted up, down, left, right, forward, and/or backward (see, e.g., FIG. 3). The adjustability of the device retainer 225 may advantageously permit a user to line up a camera of the electronic display device 230 with the viewer of a sight 235 mounted on the Picatinny-style rail 220, such that a view through the viewer of the sight may be displayed on a display screen 240 of the electronic display device, when in operation. In the depicted example, the sight 235 is a night vision sight currently focused in on a deer 245. Because the camera of the device 230 is aligned with a viewer of the sight 235, the display screen of the device 230 shows the image of the deer 245 as viewed through the viewer of the sight 235. A hunter using the bracket 200 in this scenario can therefore beneficially clearly pinpoint their prey target (the deer 245) while operating in low light conditions, such as in the deep of night. The hunter may find satisfaction and excitement in stalking prey during the night, and may beneficially be at a significant advantage over their prey due to the ability of the hunter to accurately perform bow hunting while their prey is wandering around in the darkness.

With regards to FIG. 2B, a mounting bracket 200A similar to the bracket 200 in FIG. 2A is shown. The mounting bracket 200A differs from bracket 200 in that the bracket 200A includes a universal electronic display device retainer 225A. The retainer 225A is universal in the sense that it is configured to retain different size devices 230. For example, the retainer 225A includes a first clamp 248A and a second clamp 248B. The first clamp 248A clamps the right side of the device 230 with the mount 200A, while the second clamp 248B clamps the left side of the device 230 with the mount 200A. The clamps 248A, 248B can be adjusted using the clamp adjustment knobs 249A, 249B, respectively. In some embodiments, a distal end of the knobs 249A, 249B, when turned in a tightening direction, may press against the device 230 to create a mechanical compression fit to retain the device in the retainer 225A. For example, the knobs 249A, 249B may include a threaded shaft that mates with a respective threaded aperture in the clamps 249A, 249B, such that tightening of the knob forces a distal end of the threaded shaft against an outer housing of the device 230. In various examples, twisting of the knobs 249A, 249B in a tightening direction may (respectively) shorten the length of the clamps 248A, 248B, such that the clamps may mechanically retain the device with the retainer 225A. The universal retainer 225A may advantageously allow for adaptation of the mount to suit devices 230 made in many different sizes (e.g., mini, small, medium, large) from many different types of manufacturers (e.g., iPhone®, Samsung® Galaxy®, Google® Pixel®, etc.)

Figure 3:
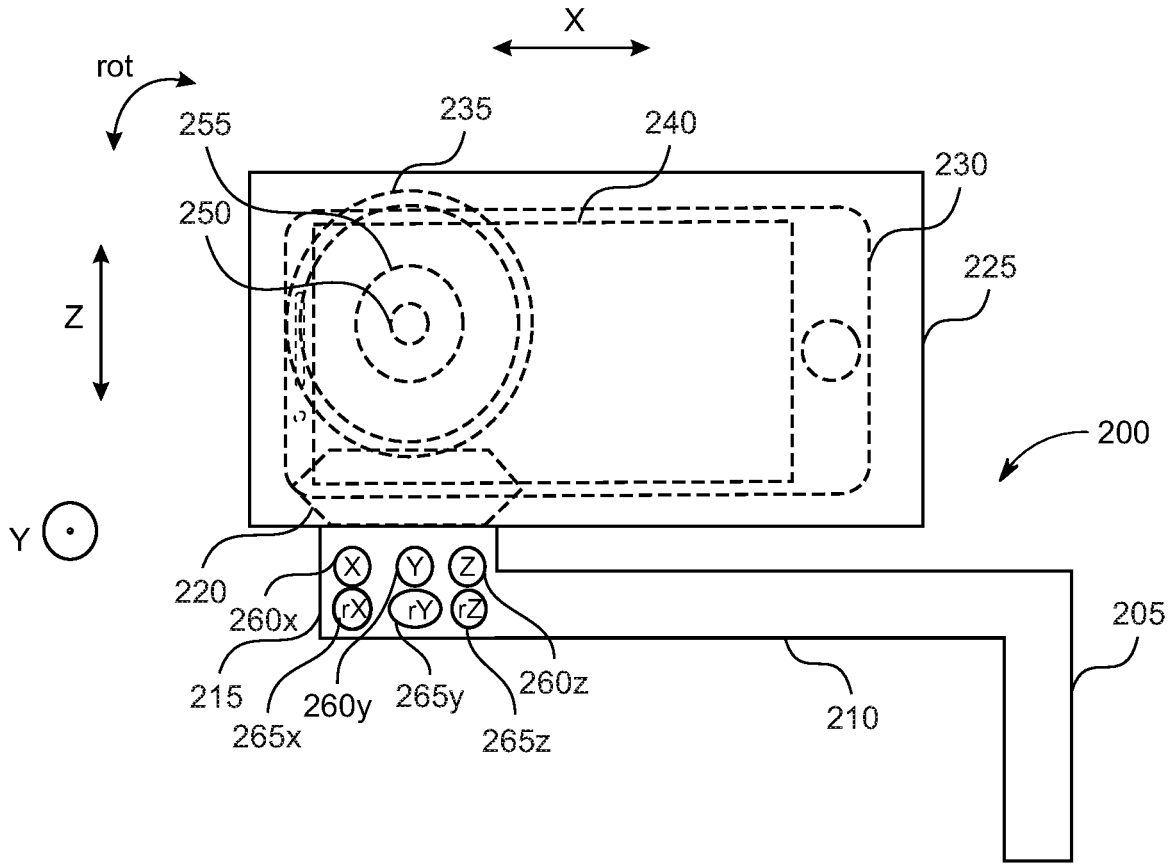
FIG. 3 depicts a back elevation view of an exemplary mounting bracket illustrating optical alignment between an exemplary sight and an exemplary electronic display device and exemplary optical alignment calibration features.

FIG. 3 depicts a back elevation view of an exemplary mounting bracket illustrating optical alignment between an exemplary sight and an exemplary electronic display device and exemplary optical alignment calibration features. As shown in the exemplary depiction of FIG. 3, the sight 235 is mounted on the bracket 200, while the display device 230 is retained by the retainer 225. The sight 235 includes a viewer 255. The viewer 255 may be viewed by a camera 250 of the display device 230. In various embodiments, the retainer 225 may be fixed to the bracket 200 in a predetermined position such that the camera 250 of the display device 230 will align with the viewer 255 of the sight 235 when the display device 230 is placed within the retainer 225. In some examples, a user may mount a different type of sight on the bracket 200, which may cause the viewer 225 of the sight 235 to not be properly aligned with the viewer 255 of the sight 235 when the display device 230 is placed within the retainer 225. Accordingly, in this depicted embodiment, the bracket 200 includes position and rotation adjustment features, which permit a user to properly calibrate the position of the retainer 225 such that the viewer 225 of the sight 235 becomes properly aligned with the viewer 255 of the sight 235.

The position adjustment features include an x-axis adjustment dial 260*x*, a y-axis adjustment dial 260*y*, and a z-axis adjustment dial 260*z* located on a back end of the sight support section 215. The x-axis adjustment dial may be used for adjusting a relative x-axis distance between the sight support section 215 and the electronic display device retainer 225. For example, if a user places a second (different) type of display device into the retainer 225, the camera of the second display device may be offset (in the x-direction) from the camera of the first display device, such that camera of the second display device is not aligned with the viewer 255. Accordingly, a user may advantageously turn the x-axis adjustment dial 260*x* to move the retainer 225 to the left or the right to properly align the camera of the second display device with the viewer 255 of the sight 235. The y-axis adjustment dial 260*y* may be used for adjusting a relative y-axis distance between the sight support section 215 and the electronic display device retainer 225. For example, if a user mounts a second (different) type of sight onto the bracket 200, the viewer of the second type of sight may be offset forward or backward from the viewer of the first sight, thus bringing the view of the viewer out of focus of the camera 250. Accordingly, a user may advantageously turn the y-axis adjustment dial 260*y* to move the retainer 225 forward or backward to properly focus the viewer 255 of the sight 235 with the camera of the second display device. The z-axis adjustment dial 260*z* may be used for adjusting a relative z-axis distance between the sight support section 215 and the electronic display device retainer 225. For example, if a user mounts a second (different) type of sight onto the bracket 200, the viewer of the second type of sight may be higher or lower than the viewer of the first sight. Accordingly, a user may advantageously turn the z-axis adjustment dial 260*z* to move the retainer 225 up or down to properly align the camera of the second display device with the viewer 255 of the sight 235.

The rotation adjustment features include an x-axis rotation adjustment dial 265*x*, *y*-axis rotation adjustment dial 265*y*, and z-axis rotation adjustment dial 265*z* located on a back end of the sight support section 215. The rotation adjustment dials 265*x*, 265*y*, 265*z* may allow a user to rotate the retainer 225 about any of the x-axis, the y-axis, or the z-axis. Rotation of the retainer 225 may beneficially enable a user to (1) properly align the camera 250 with the viewer 255, and/or (2) properly set the viewing angle of the display device 230 so the user can effectively view the display 240 of the display device when they are drawing the bow and preparing for a shot.

Figure 4A:
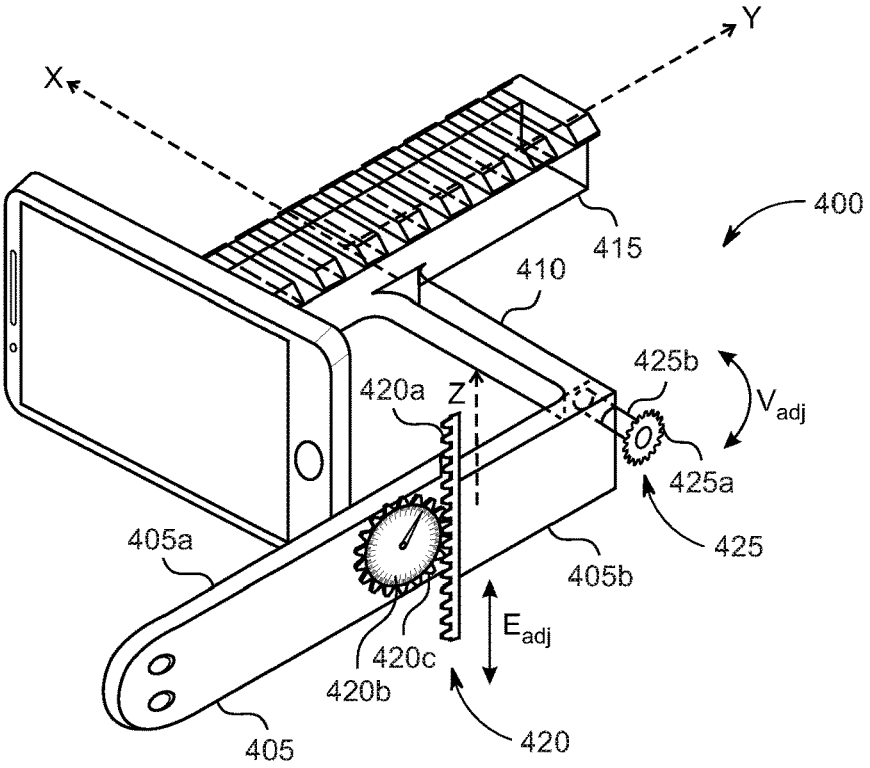
FIGS. 4A and 4B depict top back perspective views of an exemplary mounting bracket having exemplary elevation and vertical angle adjustment mechanisms.
Figure 4B:
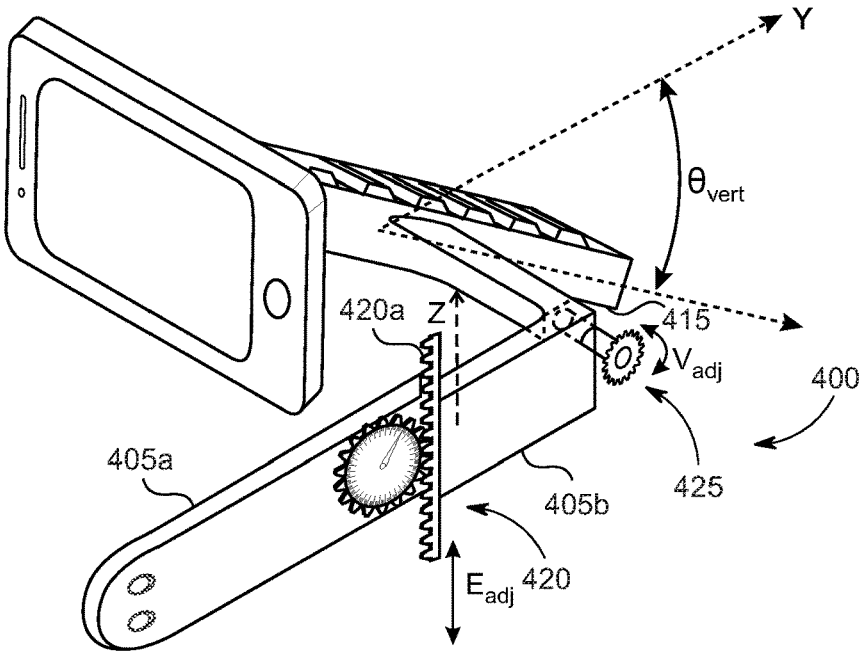

FIGS. 4A and 4B depict top back perspective views of an exemplary mounting bracket having exemplary elevation and vertical angle adjustment mechanisms. A mounting bracket 400 includes a bow coupling portion 405, a laterally extending bridge 410, and a longitudinally extending mounting portion 415. The bow coupling portion 405, in this exemplary embodiment, includes a proximal section 405*a* and a distal section 405*b*, which are configured to be vertically displaced from one another. The sections 405*a* and 405*b* can be vertically displaced relative to one another by means of an elevation adjustment assembly 420, which includes, in this exemplary depiction, a bow coupling portion rack 420*a* and pinion 420*b* mechanism. For example, the rack may be fixedly coupled to the distal section 405*b*, while the pinion may be rotatably coupled to the proximal section 405*a* and driven by an elevation adjustment dial

420*c*, such that the distal section 405*b* may be displaced up or down relative to the proximal section 405*a* upon turning of the elevation adjustment dial 420*c*.

Coupled with the distal portion 405*b* and the bridge 410 is a vertical angle adjustment assembly 425. In this exemplary depiction, the vertical angle adjustment assembly 425 includes a vertical angle control knob 425*a* coupled to a knob shaft 425*b*. In some examples, turning the vertical angle control knob 425*a* may rotate the bridge 410 around an x-axis (or axis parallel to the x-axis), and relative to the distal portion 405*b*. In various embodiments, the knob 425*a* may be a tightening knob that fixes the bridge 410 in a fixed position relative to the distal portion 405*b* when the knob is sufficiently tightened, and allows for rotation of the bridge 410 relative to the distal portion 405*b* when the knob is sufficiently loosened. In various examples, the end of the knob shaft 425*b* may be fixed to (e.g., integrally formed with or welded to) a proximal end of the bridge 410.

FIG. 4A depicts the bracket 400 in a configuration with zero elevation adjustment and zero vertical angle adjustment. A user may find that they can effectively use the bracket 400 without any adjustments to elevation or vertical angle. In contrast, FIG. 4B depicts the bracket 400 with a non-zero elevation adjustment and non-zero vertical angle adjustment. Specifically, the elevation adjustment assembly 420 has been calibrated by a user to lower the vertical elevation of the distal portion 405*b* relative to the proximal portion 405*a* by a vertical distance $Z_0$. A user has also calibrated the vertical angle adjustment assembly 425 to lower a vertical angle the mounting portion 415 makes with horizontal (y-axis) by an amount Overt. A user may find that adjusting the elevation and the vertical angle of the bracket 400 may make viewing of the display screen of the display device easier for the user. Accordingly, the user may make independent, on-the-fly adjustments to properly calibrate the elevation and vertical angles of the bracket 400 to fit the unique needs of the user.

Figure 5A:
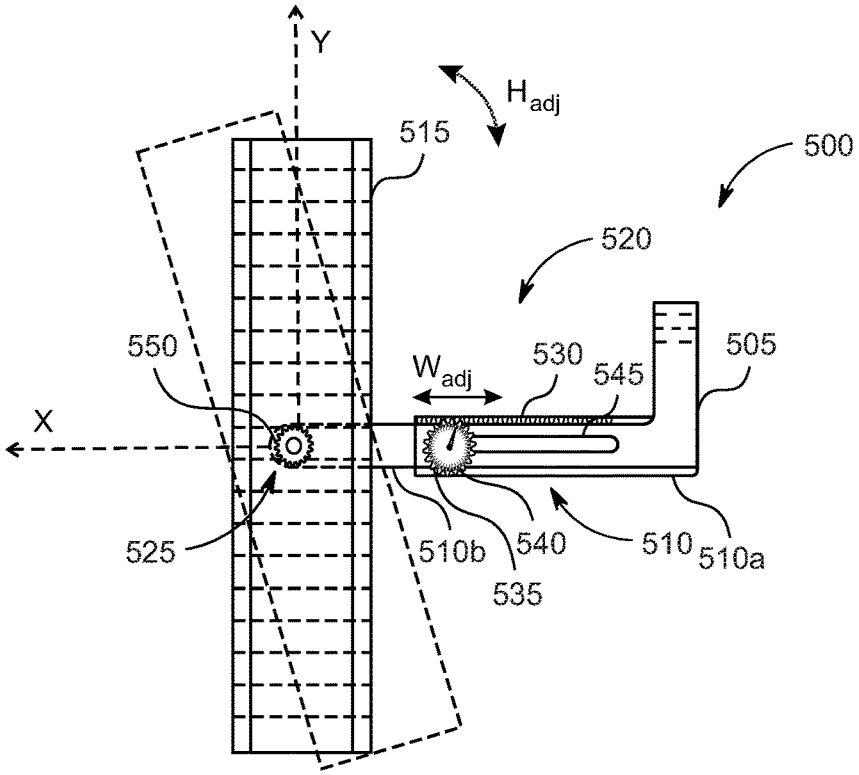
FIGS. 5A and 5B depict bottom plan and top back perspective views, respectively, of an exemplary mounting bracket having exemplary windage and horizontal angle adjustment mechanisms.
Figure 5B:
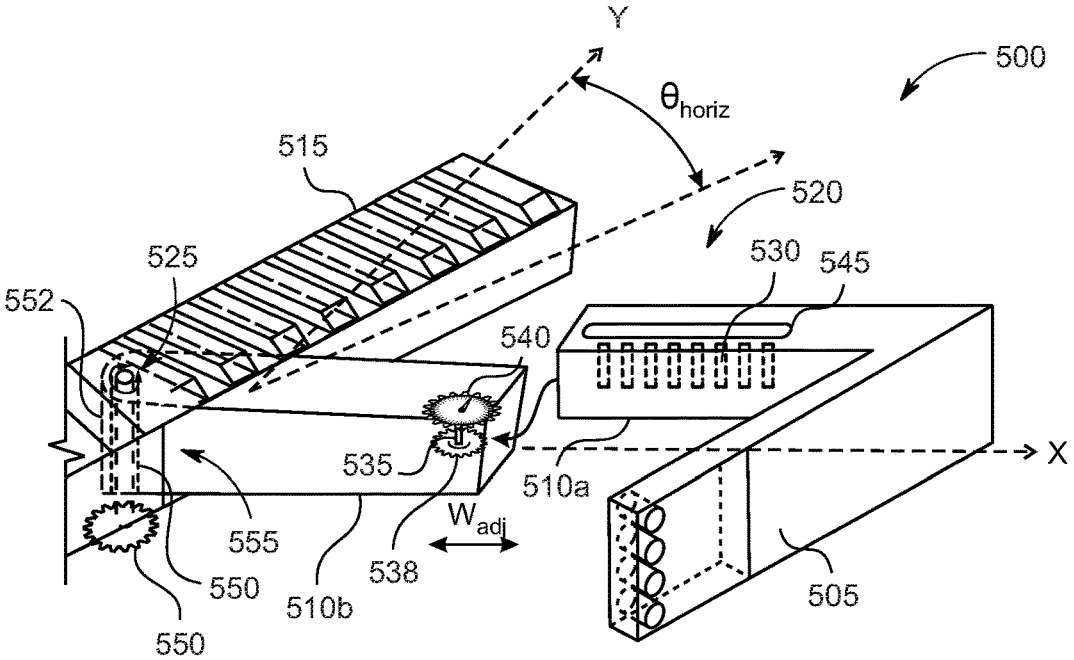

FIGS. 5A and 5B depict bottom plan and top back perspective views, respectively, of an exemplary mounting bracket having exemplary windage and horizontal angle adjustment mechanisms. As shown in FIG. 5A, a mounting bracket 500 includes a bow coupling portion 505, a laterally extending bridge 510, and a longitudinally extending mounting portion 515. The bracket 500 includes a windage adjustment assembly 520 and a horizontal angle adjustment assembly 525. In this exemplary depiction, the bridge 510 is formed in two parts: a bridge proximal portion 510*a*, and a bridge distal portion 510*b*. The portions 510*a*, 510*b* are configured to move horizontally relative to one another. The amount of horizontal displacement of portion 510*a* relative to portion 510*b* can be configured and controlled using the windage adjustment assembly 520.

The windage adjustment assembly 520 includes a bridge rack 530 and pinion 535 mechanism. The rack 530 is fixedly coupled to the proximal portion 510*a*, while the pinion is rotatably coupled to the distal portion 510*b*. Mechanically coupled to the pinion 535 by means of a shaft 538 (see FIG. 5B) is a windage adjustment knob 540. A user may turn the windage adjustment knob 540, which in turn, imparts rotational motion on the pinion 535, which in turn, imparts lateral/horizontal displacement to the rack 530. Accordingly, the user may advantageously customize a windage adjustment factor to the bracket 500 using the knob 540 of the windage adjustment assembly 520. In this exemplary depiction, the distal portion 510*b* moves laterally/horizontally within the proximal portion 510*a*. Since the knob 540 extends from the distal portion 510*b*, a channel 545 is made in the proximal portion 510*a*, to allow the knob 540 and associated shaft to slide along the proximal portion 510*a*.

The horizontal angle adjustment assembly 525 includes a horizontal angle adjustment knob 550. Mechanically coupled to the knob 550 is a shaft 552 (see FIG. 5B)). The shaft 552 facilitates a rotational coupling between a distal end of bridge 510 and the mounting portion 515. The rotational orientation between the bridge 510 and the mounting portion 515 may be controlled/customized/configured using the horizontal angle adjustment assembly 525.

In various examples, an on-the-fly windage/elevation adjustment mechanism may include an elevation adjustment feature and a windage adjustment feature. The elevation and/or windage adjustments may include rotatable gears (e.g., cog, spur gear, bevel gear, worm wheel) that engage a toothed structure to achieve a specific user-desired elevation/windage. In some examples, the elevation and/or windage adjustments may include a rack and pinion mechanism.

In some examples, the on-the-fly windage/elevation adjustment mechanism may an intermediate coupling mount. For example, the on-the-fly windage/elevation adjustment mechanism may be included with the intermediate coupling mount that couples at a proximal end to the bow, and couples at a distal end to the mounting bracket. In some examples, the on-the-fly windage/elevation adjustment mechanism may be integrally formed with the mounting bracket. The on-the-fly windage/elevation adjustment mechanism may advantageously allow for quick, immediate, and toolless adjustments to windage/elevation.

Figure 6:
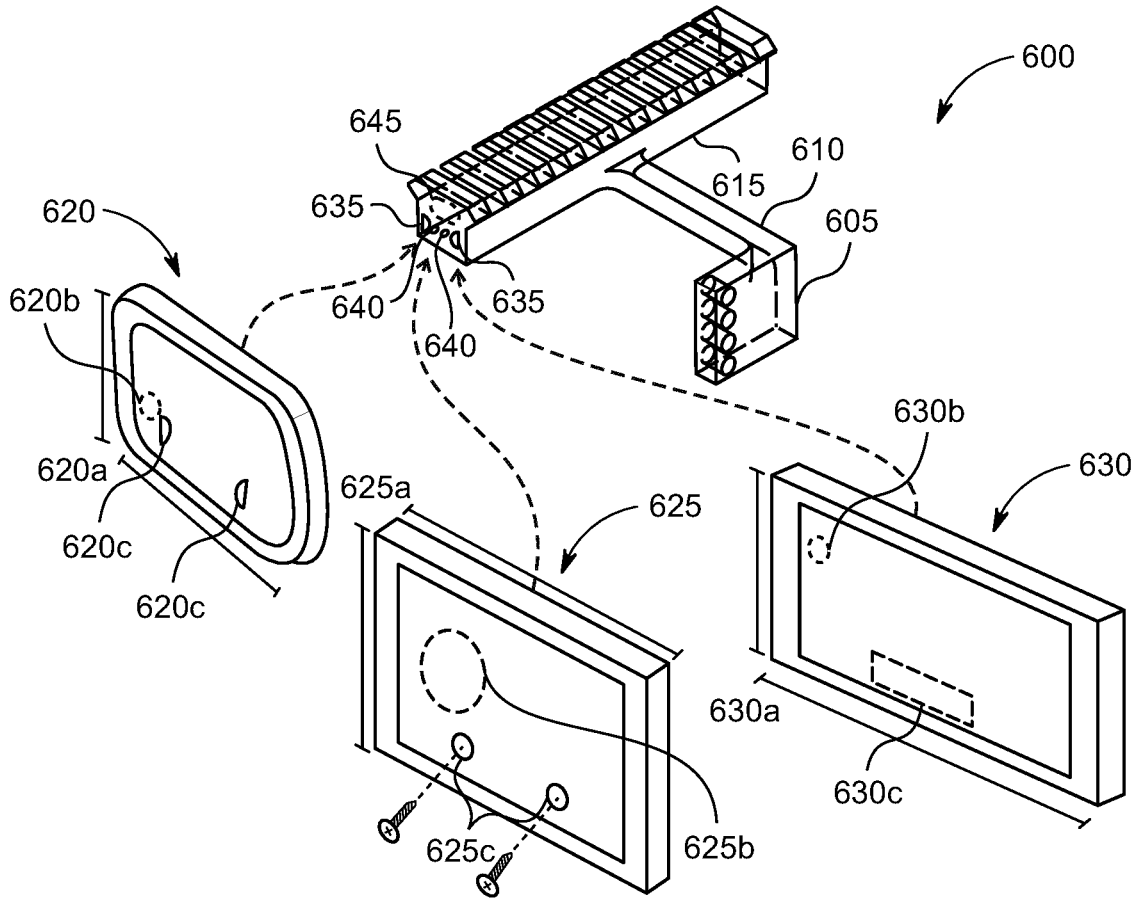
FIG. 6 depicts a back top perspective view of an exemplary mounting bracket having a variety of exemplary releasably coupled electronic display device holders.
Figure 7:
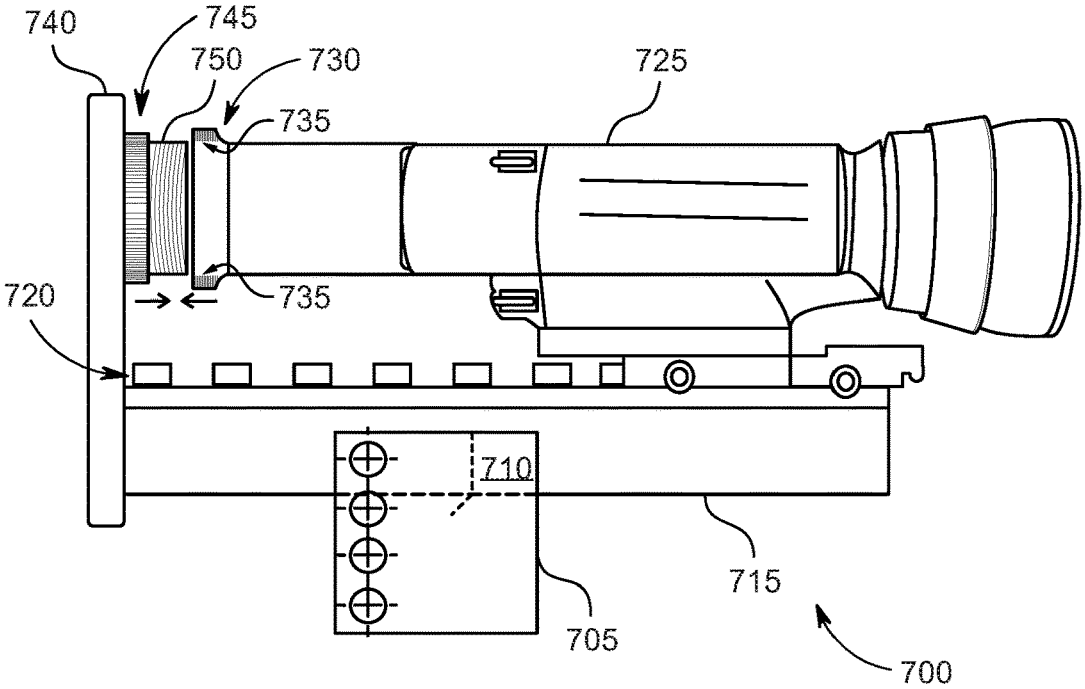
FIG. 7 depicts a side elevation view of an exemplary mounting bracket having an exemplary electronic display device holder, an exemplary sight, and an exemplary mechanical coupling feature to couple an optical aperture of the holder with an optical viewer of the sight.

FIG. 6 depicts a back top perspective view of an exemplary mounting bracket having a variety of exemplary releasably coupled electronic display device holders. A mounting bracket system 600 includes a bow coupling portion 605, a laterally extending bridge 510, and a longitudinally extending sight mounting portion 615. The system 600 includes a plurality of device retainers 620, 625, 630 configured to releasably couple to the sight mounting portion 615. Each retainer 620, 625, 630 is sized to fit a certain dimension electronic display device. For example, retainer 620 may be sized (with dimensions 620*a*) to fit an iPhone® 7 smartphone, retainer 625 may be sized (with dimensions 620*b*) to fit a Samsung® Galaxy® smartphone, and retainer 630 may be sized (with dimensions 620*c*) to fit a Google® Pixel® smartphone. Each retainer 620, 625, 630 may also have differently located/sized camera apertures 620*b*, 625*b*, 630*b* that are adapted for a specific type of electronic display device. For example, the aperture 620*b* may be a smaller aperture located near the vertical bottom of the retainer 620, the aperture 625*b* may be a larger aperture located near the vertical center of the retainer 625, and the aperture 630*b* may be a smaller aperture located near the vertical top of the retainer 630.

Furthermore, each device retainer 620, 625, 630 may have a different type of coupling mechanism to couple the retainer to the sight mounting portion 615. For example, the retainer 620 may have a pair of snap features 620*c* configured to mechanically couple with (snap to) complementary snap features 635 of the portion 615. In another example, the retainer 625 may have a pair of holes configured to mechanically couple with (via screws) complementary holes 640 of the portion 615. In yet another example, the retainer 630 may have a permanent magnet 630*c* configured to magnetically couple with a complementary permanent magnet 640 of the portion 615.

By making the device retainers 620-630 releasable from the portion 615, a user may advantageously pick which retainer to use based on their specific device. Another advantage to making the device retainers 620-630 releasable from the portion 615 is that a user may wish to use the mounting bracket system 600 without a sight or electronic display device. For example, a user may desire to simply hunt using a laser sight mounted on the portion 615 instead of a thermal or night vision sight. In such a scenario, the user may simply detach the retainer from the portion 615 and couple a laser sight to the Picatinny style rail of the portion 615. In this sense, the mounting bracket may be a modular, transformable, and adaptable system, essentially functioning as a "dual-purpose" system that can be customized to fit the particular wants and needs of the user.

A mounting bracket 700 includes a bow coupling portion 705, a laterally extending bridge 710, a longitudinally extending mounting portion 715, and an electronic device retainer 740. The mounting portion 715 includes a Picatinny-style rail 720. Mounted on the rail 720 is a (thermal) sight 725. The sight 725 includes a viewer 730 having a retainer coupling feature (e.g., internal threads 735) along an inner surface of the viewer 730. The retainer 740 is shown as being mechanically coupled (e.g., fixedly) to a proximal end of the mounting portion 715.

The retainer 740 as depicted includes an inner channel (not shown) having dimensions configured to receive a smartphone. The retainer 740 also includes a sight coupling mechanism 745 (e.g., a notched circle having complementary threads 750). The sight coupling mechanism 745 is aligned with a camera viewing aperture (see, e.g., FIGS. 3 and 6) in the retainer 740, such that a camera of a smartphone, for example, placed in the retainer 740, aligns with the viewer 730 of the sight 725. In this way, the view through the sight 725 may be viewed by the camera of the smartphone retainer in the retainer 740, such that the smartphone may display this view on the display screen of the smartphone. The sight coupling mechanism 745 may include complementary threads 750 configured to engage the internal threads 735 of the viewer 730 of the sight 725. A user may twist the mechanism 745 (e.g., using the notched circle) to mate the threats 750 with the threads 730 to mechanically and securely couple the retainer 740 with the sight 725. Such a mechanical and secure coupling may advantageously keep the retainer 740 and the sight 725 in a fixed relationship with one another, such that wiggling or vibration imparted to one of the retainer 730 and sight 725 does not negatively affect the view of the camera through the viewer 730. Put another way, when the retainer 740 is mechanically and securely coupled with the sight 725 (via the sight coupling mechanism 745 and the retainer coupling feature 735), the view as seen through the camera of the electronic display device will be stable, since there is a direct mechanical attachment between the retainer 740 and the sight 725.

Some embodiments may include an exemplary smartphone device coupled to an exemplary sight via an exemplary phone mount, which may be integrated with a retainer of a bot mounting bracket. The sight 725 is configured to couple to the Picatinny-style rail 720. A smartphone (not shown) is operatively/mechanically coupled to the sight 725 via a phone mount 740. In this exemplary embodiment, the sight 500 is a thermal sight configured to detect the heat signatures of surrounding objects. Aligned with the viewer 730 of the sight 725 is the camera of the smartphone. This arrangement allows for the view through the sight 730 to be displayed on the screen of the smartphone. A silhouette of an animal may be seen on the screen of the smartphone because the temperature of the animal is distinguishable from the temperature of the ambient background by the thermal sight.

Various embodiments may relate to a unitary-construction mounting bracket that includes bow coupling section, a lateral extension section, a sight support section, and a Picatinny-style rail. The Picatinny-style rail may be integrally formed with the sight support section. The bow coupling section may include at least one aperture configured to receive a fastener (e.g., bolt, screw, pin) to couple the mounting bracket to a bow or an intermediate coupling member (e.g., on-the-fly windage/elevation adjustment mechanism). In some examples, the height-wise dimension of the bow coupling section may be orthogonal to the width-wise dimension of the extension section and the length-wise dimension of the sight support section. Exemplary dimensions of the mounting bracket may be as follows. The bow coupling section 605 may have the following dimensions: height=1", width=0.25", length=1". The extension section 610 may have the following dimensions: height=0.25", width=1.844", length=0.25". The sight support section 615 may have the following dimensions: height=0.5", width=0.617", length=3.75". The Picatinny-style rail 620 may have the following dimensions: height=0.117", (max) width=0.835", length=3.75". It may be appreciated that the exact dimensions of the mounting bracket 600 may be adjusted or customized to be smaller or larger than the above values. For example, the above values may be adjusted up or down by about 0.01", 0.05", 0.1", 0.5", 1", 1.5", 2", 3", 4", or about 5" or more.

Figure 8:
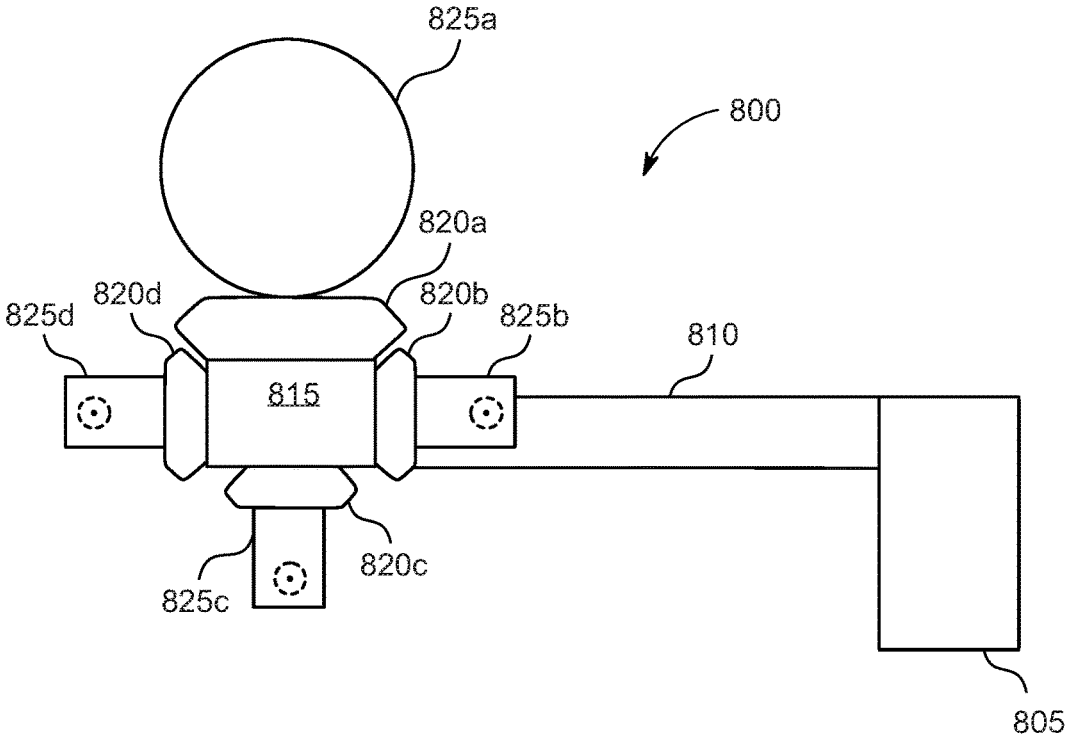
FIG. 8 depicts a back elevation view of an exemplary mounting bracket having multiple Picatinny-style rails configured to attach multiple targeting devices to the bracket.

FIG. 8 depicts a back elevation view of an exemplary mounting bracket having multiple Picatinny-style rails configured to attach multiple targeting devices to the bracket. A mounting bracket 800 includes a bow coupling portion 805, a lateral bridge 810, and a longitudinal rail portion 815 having multiple Picatinny-style rails (a top rail 820A, two opposing side rails 820B, 820D, and a lower rail 820C). The mounting bracket with multiple Picatinny-style rails may advantageously allow for mounting of multiple targeting devices to the mounting bracket. For example, as shown in FIG. 8, a sight 825A may be mounted on the top rail 820A, and three laser sights 825B, 825C, 825D may be individually mounted on the other rails 820B-820D. Such a configuration may be advantageous by allowing the laser points of the laser sights 825B-825D to be seen through the sight 825A, such that three laser points may be used to better aim the bow, as seen through the sight 825A and the camera/display screen of the electronic display device.

Although various embodiments have been described with reference to the Figures, other embodiments are possible. For example, an aiming accessory for a bow may include mechanisms for mounting the accessory to the bow, mechanisms for mounting an electronic device to the accessory, and mechanisms for mounting a sight or other device to the accessory. In some examples, a positioning accessory may be at a predetermined orientation relative to the bow. The accessory may include a mounting flange that couples to a dynamic adjustment aiming calibration system. The accessory may include an attachment member that may be, for example, a Picatinny-style rail. The accessory may be a multi-axis, dynamic positioning system that may advantageously adjust the windage/elevation of a sight coupled to a bow. In various examples, an orientation/design of a mounting bracket may be reversed/mirrored for a left-handed bow.

An electronic device may include a camera that may be configured to be in alignment with a viewfinder of an optical accessory (e.g., a thermal or night-vision sight). In some examples, the camera may be a video camera. In various embodiments, the electronic device may be a smartphone (e.g., iPhone or Android smartphone). The electronic device may include software that allows the view through the camera of the electronic device to be displayed on a display screen of the electronic device.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are contemplated.

What is claimed is:

1. A mounting system for bow hunting at night, the mounting system comprising:

a bow coupling member configured for coupling to a bow;

a laterally extending bridge mechanically coupled at a proximal end to the bow coupling member;

a longitudinally extending mounting member mechanically coupled to a distal end of the laterally extending bridge and comprising a Picatinny-style rail adapted to support and mechanically couple to a sight such that the rail is in a first plane that passes through an optical axis of the sight and that is substantially parallel to the bow, wherein the sight is at least one of: a thermal sight and a night vision sight;

a vertical angle adjustment mechanism comprising a vertical angle control element and adapted to rotate the longitudinally extending mounting member and the rail in the first plane about a first axis in response to an adjustment input applied to the vertical angle control element and, an electronic display device retainer mechanically coupled with the longitudinally extending mounting member, the electronic display device retainer adapted to align a camera of an electronic display device with a viewer of the sight to permit a user to align an optical axis of the camera with an optical axis of the viewer of the sight wherein the electronic display device retainer is configured to independently adjust the optical axis of the camera relative to the optical axis of the viewer of the sight, such that a view through the viewer of the sight is displayed on a display screen of the electronic display device when in operation, wherein the electronic display device retainer comprises a viewing aperture disposed proximate to a rear end of the longitudinally extending mounting member and adapted to align with the camera of the electronic display device when the electronic display device is retained in the electronic display device retainer, such that the camera of the electronic display device is adapted to align with the viewer of the sight via the viewing aperture, wherein the electronic display device retainer is configured to position the electronic display device in front of the bow, and wherein the laterally extending bridge is formed as a unitary body construction with the longitudinally extending mounting member.

2. The mounting system of claim 1, further comprising at least one of:

an x-axis adjustment mechanism for adjusting a relative x-axis distance between the longitudinally extending mounting member and the electronic display device retainer, a y-axis adjustment mechanism for adjusting a relative y-axis distance between the longitudinally extending mounting member and the electronic display device retainer, and, a z-axis adjustment mechanism for adjusting a relative z-axis distance between the longitudinally extending mounting member and the electronic display device retainer.

3. The mounting system of claim 1, further comprising a rotational adjustment mechanism for adjusting a relative rotational orientation between the longitudinally extending mounting member and the electronic display device retainer, the rotational adjustment mechanism adapted to rotate the electronic display device retainer in a plane.

4. The mounting system of claim 1, further comprising an elevation adjustment mechanism for adjusting a vertical position of the longitudinally extending mounting member.

5. The mounting system of claim 1, wherein:

the vertical angle adjustment mechanism is further adapted such that operation of the vertical angle control element toollessly adjusts a vertical angle between a y-axis and a mounting member axis coaxially aligned with the longitudinally extending mounting member.

6. The mounting system of claim 1, further comprising a windage adjustment mechanism for adjusting a horizontal position of the longitudinally extending mounting member.

7. The mounting system of claim 1, further comprising a horizontal angle adjustment mechanism for adjusting a horizontal angle between a y-axis and a mounting member axis coaxially aligned with the longitudinally extending mounting member.

8. The mounting system of claim 1, further comprising an aperture-viewer mechanical coupling mechanism adapted to mechanically couple and optically align the viewing aperture of the electronic display device retainer with the viewer of the sight.

9. The mounting system of claim 1, wherein the longitudinally extending mounting member comprises a plurality of Picatinny-style rails.

10. The mounting system of claim 1, wherein the bow coupling member, the laterally extending bridge, and the longitudinally extending mounting member are all integrally and unitarily formed with one another.

11. A mounting system for bow hunting at night, the mounting system comprising:

a bow coupling member configured for coupling to a bow;

a laterally extending bridge mechanically coupled at a proximal end to the bow coupling member;

a longitudinally extending mounting member mechanically coupled to a distal end of the laterally extending bridge and comprising a Picatinny-style rail adapted to support and mechanically couple to a sight such that the rail is in a first plane that passes through an optical axis of the sight and that is substantially parallel to the bow; and, an electronic display device retainer mechanically coupled with the longitudinally extending mounting member, the electronic display device retainer adapted to align a camera of an electronic display device with a viewer of the sight to permit a user to align an optical axis of the camera with an optical axis of the viewer of the sight wherein the electronic display device retainer is configured to independently adjust the optical axis of the camera relative to the optical axis of the viewer of the sight, such that a view through the viewer of the sight is displayed on a display screen of the electronic display device when in operation, wherein the laterally extending bridge is formed as a unitary body construction with the longitudinally extending mounting member.

12. The mounting system of claim 11, further comprising at least one of:

an x-axis adjustment mechanism for adjusting a relative x-axis distance between the longitudinally extending mounting member and the electronic display device retainer, a y-axis adjustment mechanism for adjusting a relative y-axis distance between the longitudinally extending mounting member and the electronic display device retainer, and, a z-axis adjustment mechanism for adjusting a relative z-axis distance between the longitudinally extending mounting member and the electronic display device retainer.

13. The mounting system of claim 11, further comprising a rotational adjustment mechanism for adjusting a relative rotational orientation between the longitudinally extending mounting member and the electronic display device retainer, the rotational adjustment mechanism adapted to rotate the electronic display device retainer in a plane.

14. The mounting system of claim 11, wherein the electronic display device retainer is releasably coupled with the longitudinally extending mounting member.

15. The mounting system of claim 11, further comprising a plurality of electronic display device retainers each having different dimensions from one another and each adapted to releasably couple with the longitudinally extending mounting member.

16. A mounting system for bow hunting at night, the mounting system comprising:

a bow coupling member configured for coupling to a bow;

a laterally extending bridge mechanically coupled at a proximal end to the bow coupling member;

a longitudinally extending mounting member mechanically coupled to a distal end of the laterally extending bridge and comprising a Picatinny-style rail adapted to support and mechanically couple to a sight such that the rail is in a first plane that passes through an optical axis of the sight and that is substantially parallel to the bow; and, an electronic display device retainer mechanically coupled with the longitudinally extending mounting member, the electronic display device retainer adapted to align a camera of an electronic display device with a viewer of the sight to permit a user to align an optical axis of the camera with an optical axis of the viewer of the sight wherein the electronic display device retainer is configured to independently adjust the optical axis of the camera relative to the optical axis of the viewer of the sight, such that a view through the viewer of the sight is displayed on a display screen of the electronic display device when in operation, wherein the electronic display device retainer comprises a user-adjustable sizing control that selectively sizes the electronic display device retainer, such that the electronic display device retainer is configured to individually retain any one of a plurality of different electronic display devices each having different sizes, and wherein the laterally extending bridge is formed as a unitary body construction with the longitudinally extending mounting member.

17. The mounting system of claim 16, further comprising at least one of:

an x-axis adjustment mechanism for adjusting a relative x-axis distance between the longitudinally extending mounting member and the electronic display device retainer, a y-axis adjustment mechanism for adjusting a relative y-axis distance between the longitudinally extending mounting member and the electronic display device retainer, and, a z-axis adjustment mechanism for adjusting a relative z-axis distance between the longitudinally extending mounting member and the electronic display device retainer.

18. The mounting system of claim 16, further comprising a rotational adjustment mechanism for adjusting a relative rotational orientation between the longitudinally extending mounting member and the electronic display device retainer, the rotational adjustment mechanism adapted to rotate the electronic display device retainer in a plane.

19. The mounting system of claim 16, wherein the electronic display device retainer is releasably coupled with the longitudinally extending mounting member.

20. The mounting system of claim 16, wherein the bow coupling member, the laterally extending bridge, and the longitudinally extending mounting member are all integrally and unitarily formed with one another.

* * * * *